United States Patent [19]

Gonzalez et al.

[11] Patent Number: 4,797,863

[45] Date of Patent: Jan. 10, 1989

[54] UNDERWATER ACOUSTICAL TRANSDUCER

[75] Inventors: Manuel A. Gonzalez; David L. Hutchins, both of Seattle, Wash.

[73] Assignee: Honeywell, Inc., Minneapolis, Minn.

[21] Appl. No.: 944,050

[22] Filed: Dec. 22, 1986

[51] Int. Cl.[4] ..... H04R 17/00

[52] U.S. Cl. ..... 367/157; 367/163; 367/165; 367/174

[58] Field of Search ..... 73/170 A; 310/337, 324, 310/369; 181/101, 108, 110, 122, 124, 140, 153, 165, 169, 171, 172; 340/850; 367/1, 2, 3, 4, 5, 6, 13, 141, 153, 154, 155, 157, 159, 160, 161, 162, 163, 165, 169, 171, 172, 173, 174, 176; 342/4, 8, 9, 10, 11; 343/915; 441/10, 22, 30, 31, 32, 33

[56] References Cited

U.S. PATENT DOCUMENTS

| | | | |
|---|---|---|---|
| 2,829,520 | 4/1958 | Stanton | 367/174 |
| 3,539,979 | 11/1970 | Crall | 367/173 |
| 3,798,474 | 3/1974 | Cassand et al. | 367/169 X |
| 3,992,737 | 11/1976 | Duel et al. | 367/3 X |
| 4,183,010 | 1/1980 | Miller | 367/159 X |
| 4,189,703 | 2/1980 | Bennett | 367/173 X |
| 4,371,957 | 2/1983 | Sandoz et al. | 367/173 X |
| 4,552,243 | 11/1985 | Melillo et al. | 181/169 |
| 4,653,036 | 3/1987 | Morris et al. | 367/163 X |
| 4,695,988 | 9/1987 | Banno | 367/169 X |

FOREIGN PATENT DOCUMENTS

| | | | |
|---|---|---|---|
| 976271 | 10/1975 | Canada | 340/850 |

*Primary Examiner*—Brian S. Steinberger

*Attorney, Agent, or Firm*—Orrin M. Haugen; Thomas J. Nikolai; Frederick W. Niebuhr

[57] ABSTRACT

An underwater acoustical transducer includes an annular, spring steel band supporting a diaphragm of a woven fabric held taut by the band. A flexible piezoelectric transducing element is attached with respect to the band, typically in contiguous relation to a portion of the fabric overlying the radially outward surface of the band. The transducing element can include an electrically conductive core surrounded by flexible piezoelectric material, or alternatively, a substantially flat strip of flexible piezoelectric material.

17 Claims, 2 Drawing Sheets

UNDERWATER ACOUSTICAL TRANSDUCER

BACKGROUND OF THE INVENTION

Piezoelectric materials are well known for their tendency to generate or alter a voltage when subjected to mechanical stress. This property enables varying use of such materials, for example as a crystal in a microphone to generate electrical signals responsive to sound, or in a pressure gauge. One such use is shown in U.S. Pat. No. 4,445,384 to Royer granted May 1, 1984, assigned to the assignee of this application. Royer shows inner and outer ring electrodes 22 and 24 formed in a dielectric layer 32 which separates the electrodes from a layer of piezoelectric material, for example zinc oxide. A uniform pressure applied to layer 34 will induce piezoelectric polarizations in capacitors C1 and C2 between the piezoelectric material and electrodes 22 and 24, respectively.

Another use for piezoelectric material is in hydrophones used to detect sound transmitted through water by converting the acoustic energy into electrical energy. The hydrophone typically includes a rigid, thin walled tube of piezoelectric ceramic material, closed at each end by a rigid metal end cap. Such hydrophones must be handled with care due to the fragility of the walls. They also are quite limited in operating depth, or must be pressure compensated when used in deep water. Moreover, due to their typically small size, many such hydrophones would be required to form a large, single transducer, with individual hydrophones distributed about the transducer periphery. Such arrangement, while effective, would be prohibitively expensive.

Therefore, it is an object of the present invention to provide a large, inexpensive underwater acoustical transducer.

Another object is to provide a transducer sufficiently rugged to withstand rough handling and use in water of virtually any depth, and without pressure compensation.

Yet another object of the invention is to provide an underwater transducer that is elastically deformable from a normal, deployment configuration to a relatively compact storage configuration, retaining the tendency to rapidly assume the deployment configuration responsive to a slight disturbance.

SUMMARY OF THE INVENTION

To achieve these and other objects, there is provided an underwater acoustical transducer including a diaphragm, a flexible frame, and means for securing the periphery of the diaphragm with respect to the frame. The frame has a normal configuration but is elastically deformable into configurations other than the normal configuration. The transducer further includes a flexible piezoelectric transducing element at least substantially adjacent the frame, running the length of the frame and conforming to the configuration of the frame. Means are provided for fastening the transducing element with respect to the frame.

Preferably the frame and transducing element have an annular normal configuration. The diaphragm can comprise a woven fabric, held substantially taut when the frame is in the normal configuration.

The preferred frame is an endless band having a circumferential length substantially greater than its cross-sectional width, and a width substantially greater than the cross-sectional thickness. This permits a twisting of said frame, over upon itself into a storage configuration, with slight elastic deformation of the frame.

The preferred transducing element is a coaxial cable including an electrically conductive core surrounded by a flexible piezoelectric material. The piezoelectric material can be a composite ceramic, or polyvinylidene fluoride.

The use of the single transducing element around the transducer perimeter provides a low cost and light weight device. At the same time, the acoustical transducer in accordance with the present invention is more rugged, and usable in deep water without any pressure compensation. The transducing element runs substantially along the frame and can be connected to the fabric. Consequently, vibrations of the diaphragm in response to acoustical signals are virtually instantaneously sensed by the transducing element, to provide a directional hydrophone of large surface area more sensitive than prior art structures. The shape of the spring steel frame, particularly in the large ratio of circumferential length to width, permits an elastic twisting of the frame into a storage configuration having a diameter approximately one-third the transducer diameter in the deployed configuration for convenient storage. Further, due to its frame elasticity the hydrophone, even in deep water, readily assumes its expanded configuration in response to a slight jostling or shaking motion, thus to permit deployment under adverse conditions such as high pressures or low temperatures.

IN THE DRAWINGS

These and other features and advantages of the invention are more readily understood from examination of the following detailed description in view of the drawings, in which.

DETAILED DESCRIPTION OF THE PREFERRED EMBODIMENTS

Figure 1:
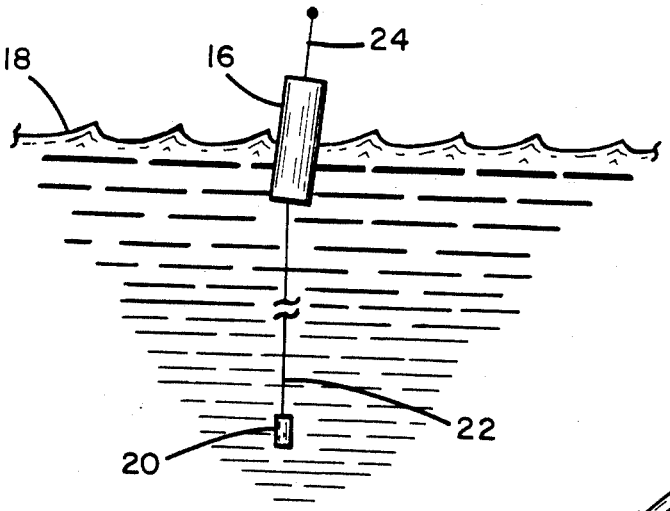
FIG. 1 is a diagrammatic view of a sonobuoy showing deployment of an underwater acoustical transducer constructed in accordance with the present invention.

Turning now to the drawings, there is shown in FIG. 1 a sonobuoy 16 floating in water indicated at 18. An underwater acoustical transducer in accordance with the present invention is embodied as a hydrophone 20 attached with respect to the bottom of sonobuoy 16 by a long tether 22, broken in the figure for convenience in illustration. A transmitter 24, mounted to the top of sonobuoy 16, emits signals in response to acoustical signals sensed by hydrophone 20. Specific apparatus for converting hydrophone signals into signals suitable for transmitting by transmitter 24 is known, not particularly germane to the present invention, and therefore not further discussed. An anchor or weight, not shown, is attached with respect to sonobuoy 16 when desired.

Figure 2:
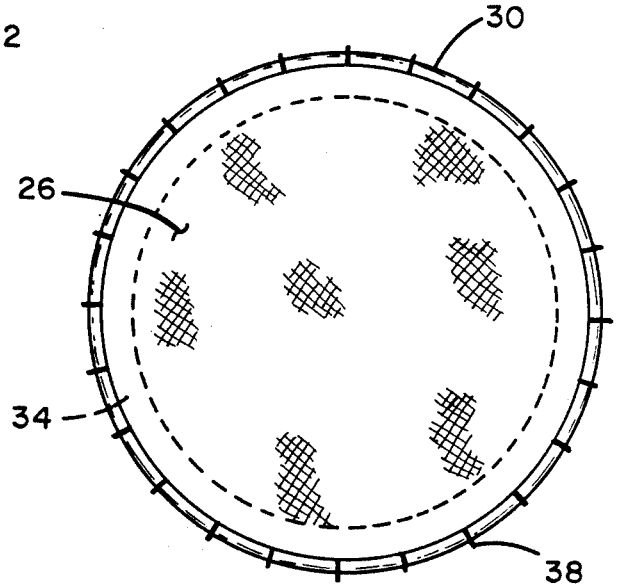
FIG. 2 is an elevational view of the acoustical transducer in its deployed configuration.
Figure 3:
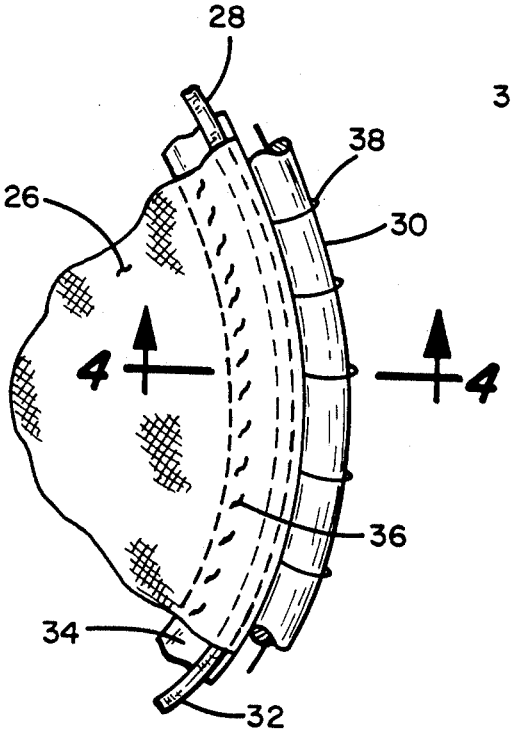
FIG. 3 is an enlarged view of a portion of FIG. 2.

FIGS. 2 and 3 show hydrophone 20 to include a flat, circular diaphragm 26 constructed of a finely woven fabric. Diaphragm 26 is supported by an annular band 28 of spring steel. More particularly, diaphragm 26 is stretched to the point of being taut, wrapped about the radially outward facing surface of band 28, and folded again radially inward to form a peripheral backing portion of the diaphragm.

Overlying the portion of the diaphragm fabric wrapped around the outward surface of band 28, and attached to the fabric, is a transducing element in the form of a coaxial cable 30. Cable 30 is annular, conforming to the normal shape of band 28, yet is yieldable and can assume a variety of shapes corresponding to shapes of band 28 as it is elastically deformed out of its normal configuration.

Hydrophone 20 is directional in the sense that it most effectively registers underwater acoustical disturbances traveling in a direction normal to the plane of diaphragm 26. In addition to sensing acoustical signals, diaphragm 26 when taut, exerts a slight, substantially uniform radially inward force along the circumferential length of band 28, and thus tends to stabilize hydrophone 20 in the normal configuration.

The attachment of diaphragm 26 and cable 30 with respect to band 28 is perhaps best understood from the enlarged view in FIG. 3. The woven fabric of diaphragm 26 is folded at band 28 to lie along the radially outward facing surface 32 of the band, then folded once again to provide a peripheral backing portion 34 behind the remainder of the diaphragm and connected to the remainder by stitching as shown at 36 and which extends around the entire hydrophone circumference.

Cable 30 is connected with respect to band 28 by a series of dielectric loops 38 which can be thread or the like, running about the cable exterior and threaded between outer surface 32 of the band and its adjacent portion of diaphragm 26. Thus, while cable 30 conforms substantially to the shape of band 28, the distance between adjacent loops 38 and contiguous relation between cable 30 and diaphragm 26 permit a more direct relation between the diaphragm and cable.

Figure 4:
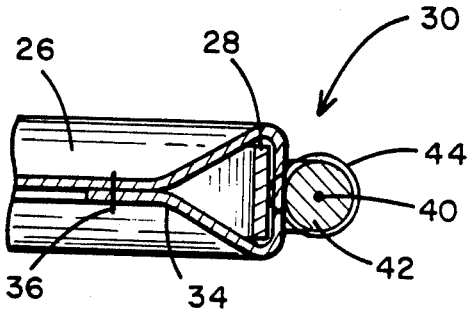
FIG. 4 is a sectional view taken along the line 4—4 in FIG. 3.

The cross-sectional view in FIG. 4 further illustrates the mounting of diaphragm 26 and cable 30 in relation to band 28, and also shows cable 30 to include an electrically conductive core 40, surrounded by a flexible piezoelectric material 42, annular in cross-section and coaxial with the core. Core 40 can be aluminum, copper or another known conductor, while the piezoelectric material is preferably polyvinylidene fluoride or a composite ceramic. A thin, dielectric casing 44 surrounds the piezoelectric material.

Figure 5:
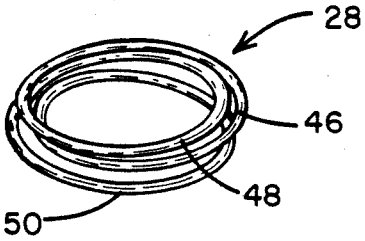
FIG. 5 is a perspective view showing a band of the transducer elastically deformed into a storage configuration.

One advantage of hydrophone 20 resides in the fact that it may be twisted, by hand, into a compact, storage configuration illustrated in FIG. 5 showing band 28 alone. Essentially, band 28 is folded over upon itself twice to form three circular turns 46, 48 and 50, each with a diameter substantially one-third the diameter of band 28 in its normal configuration.

Figure 6:
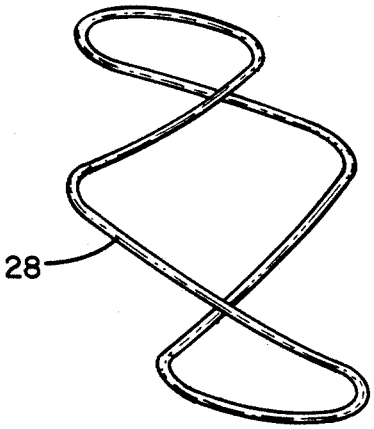
FIGS. 6 and 7 are perspective views showing the band in intermediate stages between the storage and deployed configurations.
Figure 7:
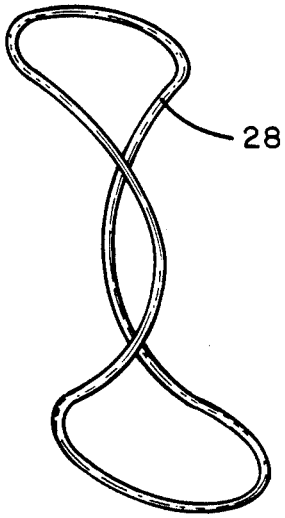

Hydrophone 20 is self-deploying in the sense that band 28, due to elastic forces stored in the compressed configuration, quickly reverts to the normal configuration in response to even slight axial separation of turns 46–50, for example with a slight jostling or twisting by hand. FIGS. 6 and 7 show two progressive, intermediate stages in band 28 as it responds to stored elastic forces until it assumes the normal, deployment configuration of FIG. 2.

The self-deployment capability of hydrophone 20 is due in part to the selection of spring steel as the material for band 28, but also to the ratios of circumferential length versus cross-sectional width, and cross-sectional width versus cross-sectional thickness selected for band 28. In particular, a band approximately ⅜" wide by 1/16" thick, and approximately 28" long (corresponding to an 18" diameter) has been found satisfactory. This yields a ratio of approximately 75:1 for length versus width, and a ratio of 6:1 for width versus thickness. Given these ratios, band 28 experiences relatively slight elastic deformation as it is twisted, by hand, from its normal configuration into the storage configuration shown in FIG. 5. Because the elastic deformation is slight, hydrophone 20 can be stored indefinitely in the compressed state, without inducing plastic deformation in the band or otherwise altering its mechanical characteristics.

Given the self-deploying nature of hydrophone 20, a pouch or other container for individual hydrophones is preferred to prevent an unintentional axial separation of turns 46–50 sufficient to cause self-deployment. This feature is an advantage for underwater deployment of the hydrophone, particularly under adverse conditions, for example in cold water or in very deep water, where even simple operations become difficult. Following use, the hydrophone can be twisted by hand, back into the storage configuration. While FIGS. 5–7 illustrate only band 28, it is to be appreciated that cable 30 readily conforms to the shape of the band whatever its configuration, and that the fabric of diaphragm 26 tends to loosely overlie turns 46–50 in the storage configuration.

Figure 8:
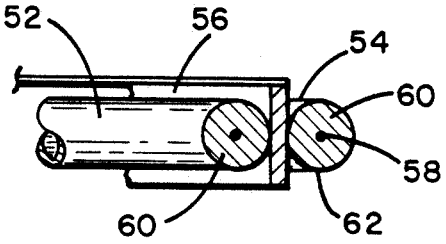
FIG. 8 is a sectional view similar to that in FIG. 4, but showing an alternative transducer.

FIG. 8 shows, in sectional view, part of a second embodiment of hydrophone utilizing two cables 52 and 54 along opposite sides of a band 56. Cables 52 and 54 are substantially identical in structure to first embodiment cable 30, each with a central conductor 58 surrounded by flexible piezoelectric material 60, which in turn is enclosed in a dielectric casing 62.

Figure 9:
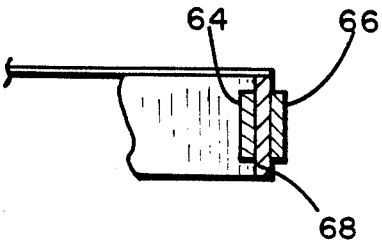
FIG. 9 is a sectional view similar to that in FIG. 4 and showing another alternative transducer.

FIG. 9 shows a portion of a third embodiment hydrophone to reveal first and second flexible piezoelectric strips 64 and 66 attached to a band 68 as transducing elements in lieu of coaxial cables. If desired, only one such flexible piezoelectric strip could be provided on either side of band 68.

When deployed as illustrated in FIG. 1, hydrophone 20 causes transmitter 24 to generate signals in response to sensed underwater acoustical disturbances. Such disturbances, particularly when occurring in the direction perpendicular to the plane of diaphragm 26, cause the diaphragm to vibrate, which in turn causes vibration and slight deformation in band 28 and cable 30. In a manner well known with respect to piezoelectric materials, the deformation of cable 30 alters the electric signal in core 40, for example by altering the voltage level or creating a piezoelectric polarization across a capacitor formed, for example, by an interruption in the core. The second and third embodiment hydrophones would function in accordance with the same principle.

Thus is provided a simple, rugged and rapidly deployable hydrophone. Despite its enhanced sensitivity to acoustic signals, the hydrophone is significantly less expensive than conventional hydrophones, particularly when large in size. The ring shape of the piezoelectric sensor is formed using flexible piezoelectric material adjacent or nearly adjacent a flexible band, thus avoiding the rigid and fragile tubular structure of earlier hydrophones. As a result, there is provided a range of useful hydrophone size and deployment depth, well beyond the range afforded by previous designs.

What is claimed is:

1. An underwater acoustical transducer including:

a diaphragm, a frame, and means for securing the periphery of said diaphragm with respect to said frame, said frame having a select deployment configuration and elastically deformable into configurations other than said select deployment configuration; and a flexible piezoelectric transducing element at least substantially adjacent said frame, running the length of said frame and conforming to the configuration of said frame; and means for fastening said transducing element with respect to said frame;

wherein said transducing element includes a first coaxial cable with an electrically conductive core surrounded by a flexible piezoelectric material, said coaxial cable substantially adjacent a radially outward surface of said frame, and wherein said means for fastening said transducing element with respect to said frame include a plurality of loops around said first coaxial cable and threaded through the periphery of said diaphragm.

2. The acoustical transducer of claim 1 wherein:

said select deployment configuration is substantially annular.

3. The acoustical transducer of claim 2 wherein:

said frame includes an endless band having a circumferential length substantially greater than its cross-sectional width, and a cross-sectional width substantially greater than its cross-sectional thickness.

4. The acoustical transducer of claim 3 wherein:

said endless band is formed of spring steel, and has a circumferential length at least twenty-five times its cross-sectional width, and a cross-sectional width at least four times its cross-sectional thickness.

5. The acoustical transducer of claim 2 wherein:

said transducing element includes a first generally flat strip of flexible piezoelectric material contiguous with a radially outward facing surface of said frame.

6. The acoustical transducer of claim 5 further including:

a second generally flat strip of flexible piezoelectric material contiguous with a radially inward facing surface of said frame.

7. The acoustical transducer of claim 1 wherein:

said diaphragm consists of a woven fabric, and is held substantially taut by said frame when in said select deployment configuration.

8. The acoustical transducer of claim 1 wherein:

said flexible piezoelectric material comprises polyvinylidene fluoride.

9. The acoustical transducer of claim 1 wherein:

said flexible piezoelectric material comprises a composite ceramic.

10. The acoustical transducer of claim 1 wherein:

said frame includes an endless band, and wherein a second coaxial cable, substantially identical to said first coaxial cable, is mounted with respect to said band on the opposite side of the band from said first coaxial cable.

11. The acoustical transducer of claim 1 wherein:

said first coaxial cable further includes a dielectric casing surrounding said flexible piezoelectric material.

12. An underwater acoustical transducer including:

a diaphragm, a frame, and means for securing the periphery of said diaphragm with respect to said frame, said frame having a select deployment configuration and elastically deformable into configurations other than said select deployment configuration; and a flexible piezoelectric transducing element at least substantially adjacent said frame, running the length of said frame and conforming to the configuration of said frame; and means for fastening said transducing element with respect to said frame;

wherein said diaphragm, at its periphery, is folded over the radially outward facing edge of said frame, then back upon itself to form two contiguous layers of said diaphragm radially inwardly of said frame, and said means for securing the periphery of said diaphragm with respect to said frame includes stitching running through and joining said contiguous layers.

13. An underwater acoustical transducer including:

a flexible frame expandable to a select frame deployment configuration; a pliable diaphragm; and a means for securing the periphery of said diaphragm with respect to said frame whereby said frame, when in said frame deployment configuration, supports said diaphragm in a select diaphragm deployment configuration; and a flexible piezoelectric transducing element running along the length of said frame, and a means for fastening said transducing element with respect to said frame whereby said transducing element conforms to said frame; and said diaphragm, when supported under water by said frame in said diaphragm deployment configuration, vibrates in response to a sensed underwater acoustical disturbance, and thereby applying an external force to said frame through said securing means to elastically deform said frame and said transducing element.

14. The acoustical transducer of claim 13 wherein:

said diaphragm consists of a woven fabric, said frame when in said frame deployment configuration maintaining said fabric substantially taut.

15. The acoustical transducer of claim 14 wherein:

said frame includes an endless band having a circumferential length substantially greater than its cross-sectional width, and a cross-sectional width substantially greater than its cross-sectional thickness, and wherein said frame forms a ring when in said frame deployment configuration.

16. The acoustical transducer of claim 15 wherein:

said means for fastening said transducing element with respect to said frame include a plurality of loops around said transducing element and threaded through the periphery of said diaphragm.

17. The acoustical transducer of claim 15 wherein:

said diaphragm, at its periphery, is folded over the radially outward facing edge of said endless band, then back upon itself to form two contiguous layers of said woven fabric radially inwardly of said band, and said means for securing the periphery of said diaphragm with respect to said band includes stitching running through and joining said contiguous layers.

* * * * *